US007963367B2

(12) United States Patent
Wilson

(10) Patent No.: US 7,963,367 B2
(45) Date of Patent: Jun. 21, 2011

(54) TOEBOARD CLAMP SYSTEM

(75) Inventor: Stephen Wilson, Toronto (CA)

(73) Assignee: Brand Services, LLC, Chesterfield, MO (US)

( * ) Notice: Subject to any disclaimer, the term of this patent is extended or adjusted under 35 U.S.C. 154(b) by 933 days.

(21) Appl. No.: 11/807,968

(22) Filed: May 31, 2007

(65) Prior Publication Data

US 2007/0278042 A1 Dec. 6, 2007

(30) Foreign Application Priority Data

Jun. 1, 2006 (CA) ..... 2549260

(51) Int. Cl.
*A47L 3/02* (2006.01)

(52) U.S. Cl. ..... 182/112; 182/113; 182/128; 182/186.7; 256/65.01; 256/68; 248/229.13

(58) Field of Classification Search ..... D8/395; 403/175, 387; 248/215, 229.13, 316.5; 182/128, 182/186.7, 112, 113; 256/65.01, 68
See application file for complete search history.

(56) References Cited

U.S. PATENT DOCUMENTS

| | | | | | |
|---|---|---|---|---|---|
| 1,739,057 | A | * | 12/1929 | Bock | 40/658 |
| 2,136,696 | A | * | 11/1938 | Lamb | 182/113 |
| 2,187,642 | A | * | 1/1940 | Brown | 403/399 |
| 3,268,252 | A | * | 8/1966 | Rolland | 403/296 |
| 3,782,499 | A | * | 1/1974 | Fisher | 182/230 |
| 3,785,602 | A | * | 1/1974 | Juculano | 248/214 |
| 3,836,106 | A | * | 9/1974 | Gray | 248/229.26 |
| 3,844,520 | A | * | 10/1974 | Werner et al. | 248/228.3 |
| 3,853,203 | A | * | 12/1974 | Werner et al. | 182/113 |
| 4,068,423 | A | | 1/1978 | Marsh | |
| 4,219,285 | A | * | 8/1980 | Hayashi | 403/188 |
| 4,226,551 | A | | 10/1980 | Beasley | |
| 4,587,786 | A | | 5/1986 | Woods | |
| 4,598,794 | A | | 7/1986 | Anderson | |
| 4,602,470 | A | | 7/1986 | Stuart et al. | |
| 4,624,342 | A | | 11/1986 | Anderson | |
| 4,741,505 | A | | 5/1988 | Anderson | |
| 5,182,889 | A | | 2/1993 | Johnson | |
| 5,240,089 | A | * | 8/1993 | Spera | 182/186.7 |
| 5,269,394 | A | | 12/1993 | Haroldson, Sr. | |
| 5,515,941 | A | | 5/1996 | Palmer et al. | |
| 5,560,588 | A | | 10/1996 | Hilliard | |
| 5,941,345 | A | | 8/1999 | D'Alessio et al. | |
| 6,341,466 | B1 | * | 1/2002 | Kehoe et al. | 52/712 |
| 6,405,830 | B1 | | 6/2002 | Hayman | |
| 6,481,697 | B1 | | 11/2002 | Brown | |
| 6,976,557 | B2 | * | 12/2005 | Becker | 182/113 |
| 7,021,476 | B2 | * | 4/2006 | Lloyd et al. | 211/113 |
| 2005/0189173 | A1 | * | 9/2005 | Becker | 182/113 |

* cited by examiner

OTHER PUBLICATIONS

"toeboard" defined by Webster's Online Disctionart, Downloaded from http://www.websters-online-dictionary.org/definitions/toeboard?cx=partner-pub-0939450753529744%3Av0qd01-tdlq&cof=Forid%3A9&ie=UTF8&q=toeboard&sa=Search#922.*

*Primary Examiner* — Katherine Mitchell
*Assistant Examiner* — Colleen M Quinn
(74) *Attorney, Agent, or Firm* — Peter S. Gilster; Greensfelder, Hemker & Gale, P.C.

(57) ABSTRACT

A toeboard system includes toeboards of a cross section and an end configuration to assist in defining a locking corner connection of two toeboards at a scaffold upright. The system includes a toeboard clamp securable to a scaffold upright with projecting latch fingers for engaging two overlapped partially nested toeboards or two toeboards forming a generally perpendicular corner connection. A latch finger of the toeboard clamp engages a slot or port in the toeboards adjacent an end thereof to positively maintain toeboards in a perpendicular connection.

9 Claims, 9 Drawing Sheets

TOEBOARD CLAMP SYSTEM

CROSS-REFERENCE TO RELATED APPLICATIONS

This application claims priority benefit to Canadian Patent Application Serial No. 2,549,260, entitled "Toeboard Clamp System," filed on Jun. 1, 2006, and naming Stephen Wilson as inventor (referred to herein as the "'260 application"). The entire disclosure of the '260 application is incorporated by reference herein in its entirety.

BACKGROUND OF THE INVENTION

The present invention relates to toeboards for scaffolding and in particular, relates to a toeboard and clamp arrangement for securely maintaining toeboards about a work platform.

Scaffold systems are used to provide safe elevated work platforms necessary in construction and maintenance projects. Many of these scaffold systems are used to provide an elongate elevated work platform adjacent a wall of a structure. It is also common in scaffolding systems to provide a tower structure defining a raised platform which can often be of a relatively small size. Most scaffolding systems are of a modular design and define a grid system with at least corner uprights and normally include a number of uprights intermediate the corners.

In a raised work platform, it is common to have a toeboard arrangement about the work platform to provide additional safety for the workers and to also reduce the possibility of tools or other objects being kicked off the work surface. Falling objects create a serious hazard to any workers below the work surface and adjacent the scaffolding system. Existing toeboard systems are designed for specific scaffolding systems and are not suitable for use in other systems or for off modular configurations. Thus, there is a need for a toeboard system which can easily be used with different scaffolding systems where there is no requirement to provide toeboards of a specific length to match the grid system.

It is common in the construction industry to have toeboards which extend beyond the corners of a scaffolding system in what is referred to as a windmill type approach. Basically one end of the toeboard is positioned adjacent an upright and any excess length in the toeboard extends beyond the opposite corner upright. This process is then repeated such that each corner can include a projecting unused length of toeboard.

This arrangement works satisfactorily, however, it can produce problems in association with securement of the toeboard to the uprights or to the work platform. Some scaffolding systems have toeboards of a specific length to allow both joining of the toeboards in an end to end manner or to define a corner connection between the ends of two toeboards.

The present invention discloses a toeboard clamp for securing of toeboards to a scaffold upright as well as a particular toeboard to be used with the toeboard clamp.

BRIEF SUMMARY OF THE INVENTION

A toeboard clamp according to the present invention comprises a hinged band structure shaped to engage and provide a clamping force about a scaffold upright, a toeboard engaging structure to one side of the band structure that includes a base for engaging an upper flange of a first toeboard extending either side of the base, and a toeboard finger latch extending beyond the base for engagement with a second toeboard extending generally perpendicular to the first toeboard.

In a preferred aspect of the invention, the toeboard finger latch is a pair of finger arms centered on the base and extending above and below the base.

In a preferred aspect of the invention, the toeboards clamp has finger arms that are parallel to each other.

According to a further aspect of the invention, the finger arms are attached to the hinged band structure with the base attached to and joining the finger arms.

In yet a further aspect of the invention, the finger arms are angled downwardly and outwardly from the band and extend to a position forward of the band where the finger arms then extend downwardly to a position generally below the base and subsequently extend downwardly and inwardly terminating at a position generally aligned and below the base.

BRIEF DESCRIPTION OF THE SEVERAL VIEWS OF THE DRAWINGS

Preferred embodiments of the invention are shown in the drawings, wherein.

DETAILED DESCRIPTION OF THE INVENTION

Figure 1:
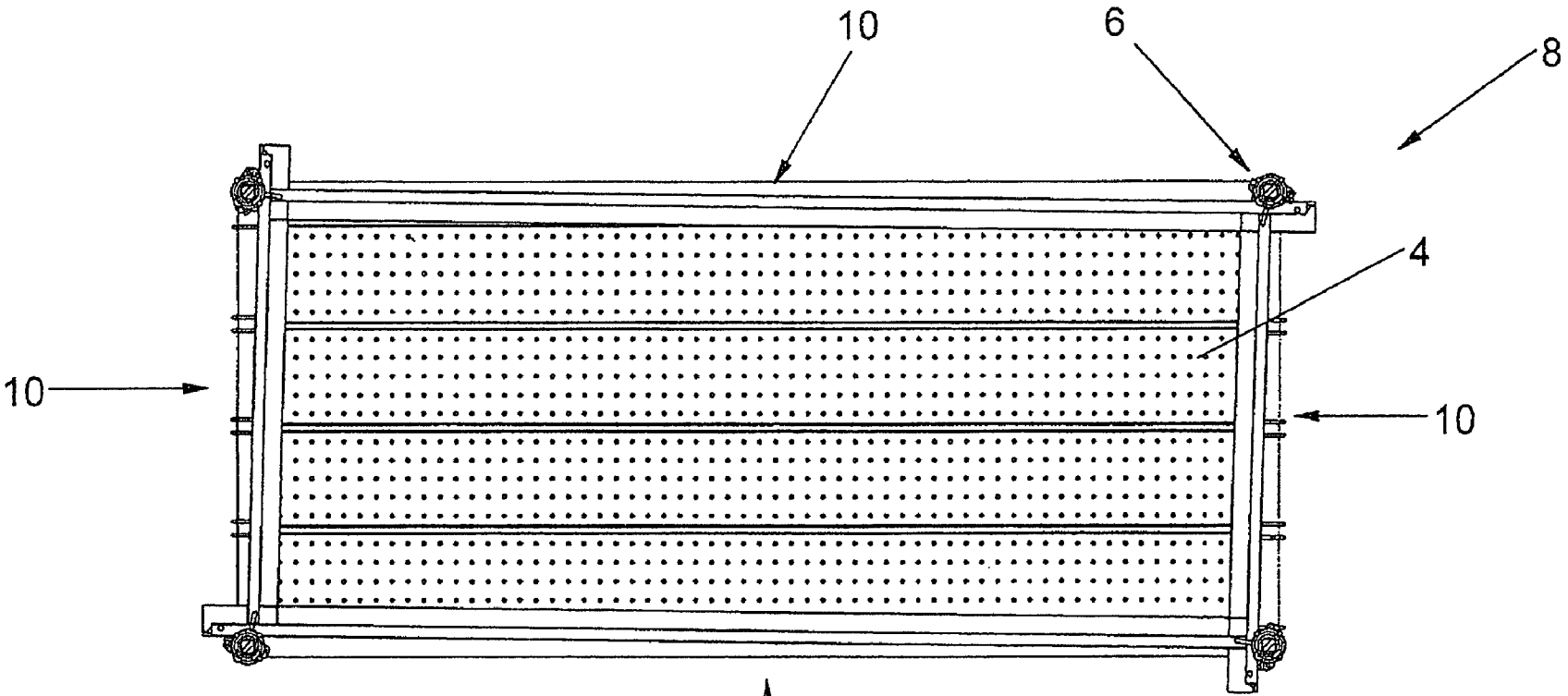
FIG. 1 is a top schematic view of a scaffold tower structure with toeboards which extend beyond the corners of the scaffold tower.

The schematic of FIG. 1 shows a top view of a scaffold system 2 configured as a scaffold tower illustrated with four uprights 6 supporting scaffold planks 4 which define a raised work surface. Toeboards 10 are provided about the work surface and each toeboard 10 extends beyond one of the upright supports 6 to provide a continuous toeboard frame about the raised work surface. This type of arrangement avoids the requirement that the toeboards are of a modular length relative to the particular dimensions of the scaffold tower.

In scaffolding systems it is important to provide a safe secure structure but it is also important to provide a system which is easy and cost effective to erect and dismantle. Often wooden 2×6's or other wood members are used for toeboards, however, they can become damaged and typically require makeshift fastening arrangements.

Figure 2:
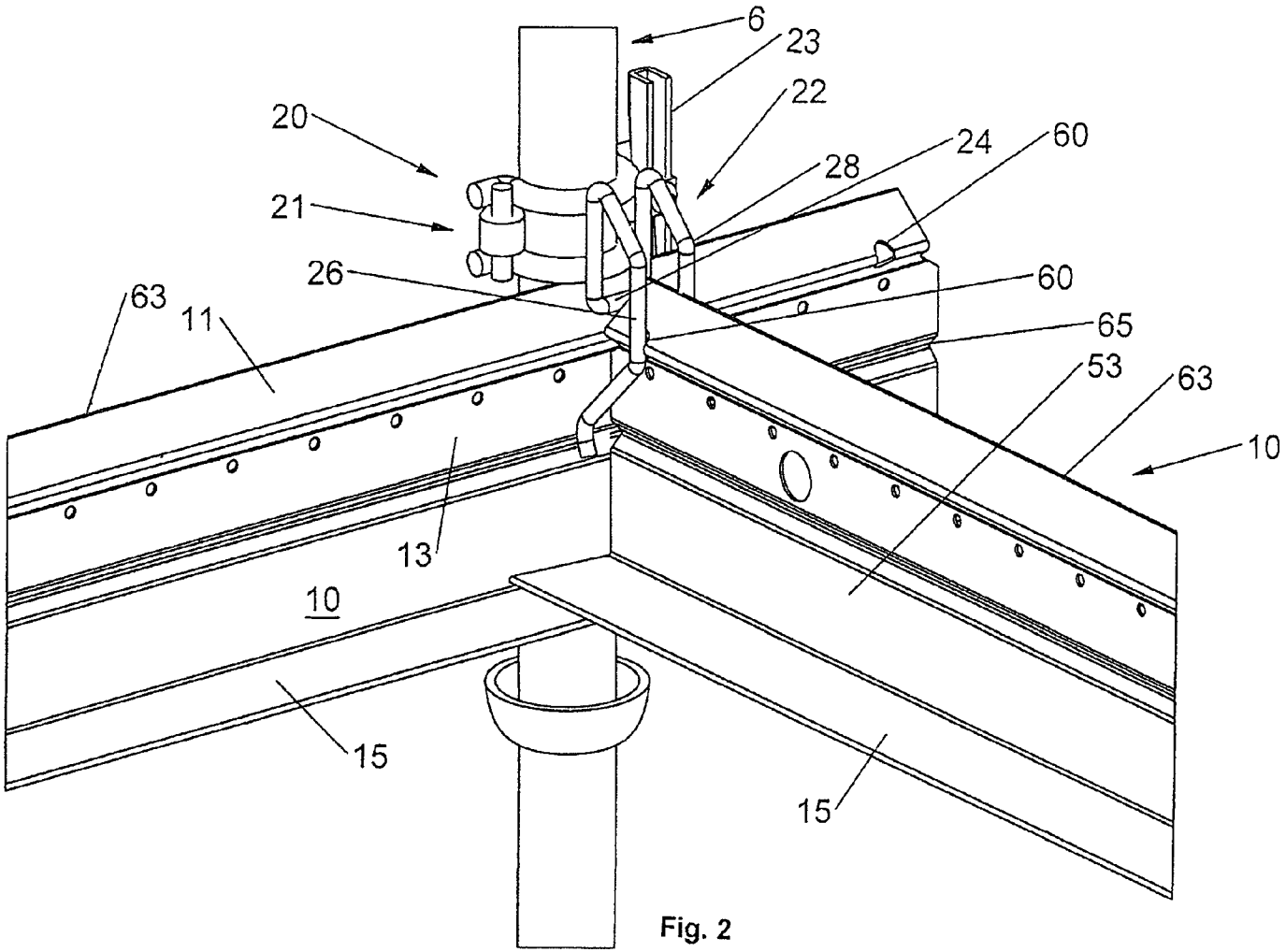
FIG. 2 is a partial perspective view showing two toeboards secured to a scaffold upright with the toeboards forming a 90 degree connection.

The perspective view of FIG. 2 shows a toeboard clamp 20 engaging a tubular scaffold support 6 and securing two toeboards 10 which are joined in a perpendicular connection at the upright support 6. The toeboard clamp 20 includes a toeboard engaging structure 22 that includes a base hold down 24 and latch fingers 26 and 28 which extend forwardly and downwardly of the base hold down 24. The base hold down 24 effectively joins the two latch fingers 26 and 28 and the base hold down 24 serves to engage the upper flange 11 of a toeboard 10 and press it into engagement with a support work surface provided below the toeboards. The work surface is not shown in FIG. 2 merely for clarity but the work structure provides a base support for the toeboards. The toeboards include a base flange 15 extending to one side of the toeboard.

Figure 4:
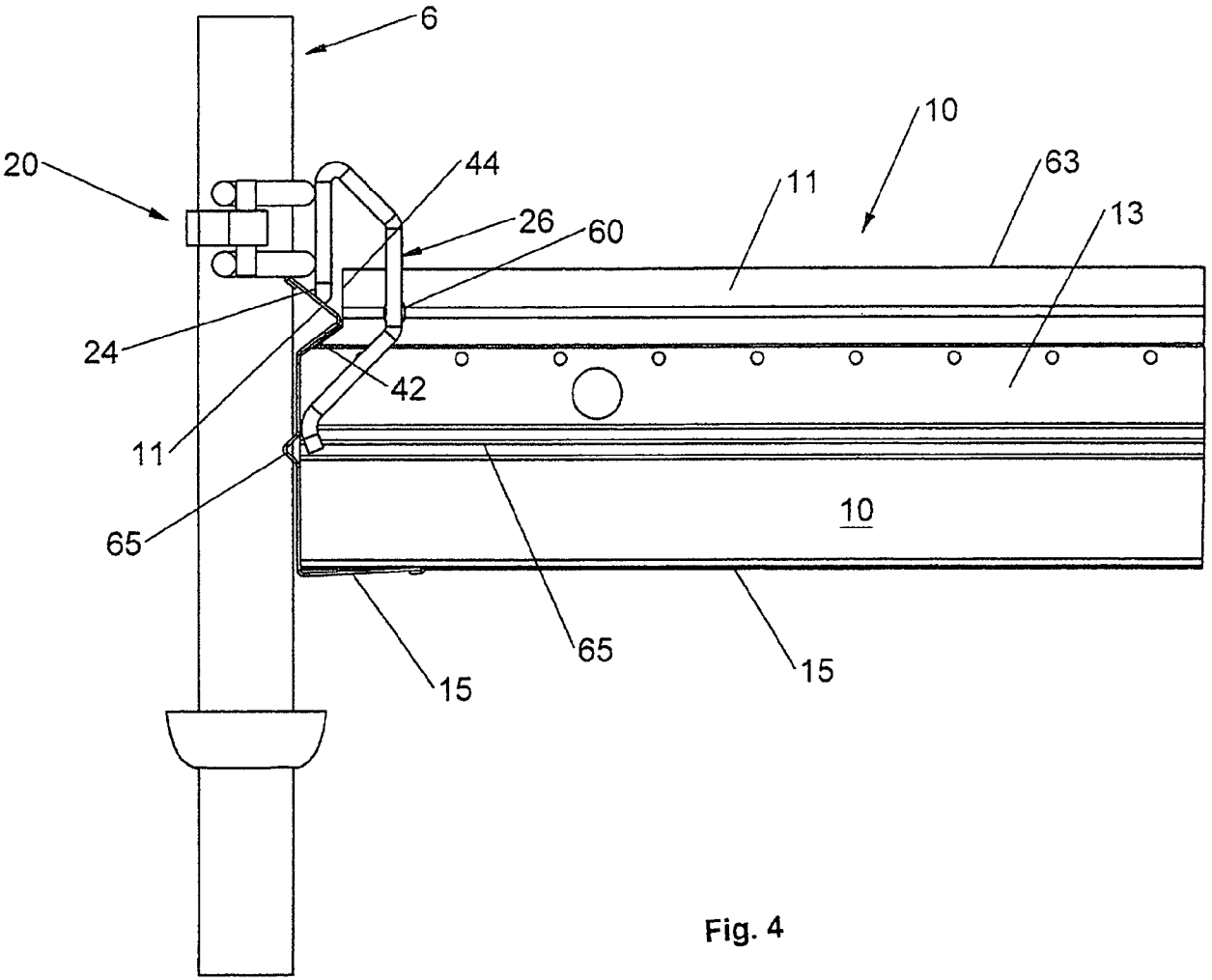
FIG. 4 is a side view of the toeboards of FIG. 3.
Figure 5:
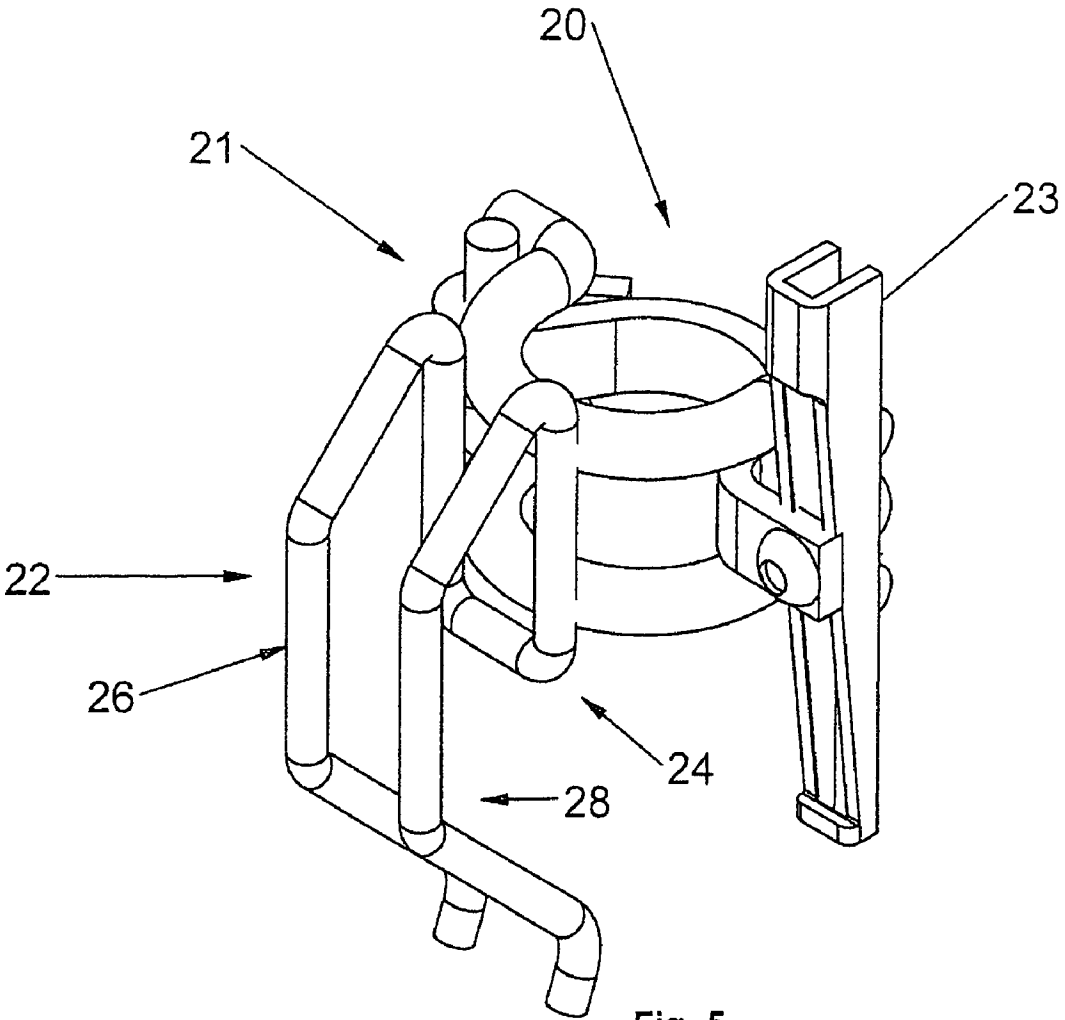
FIG. 5 is a perspective view of the toeboard clamp.
Figure 6:
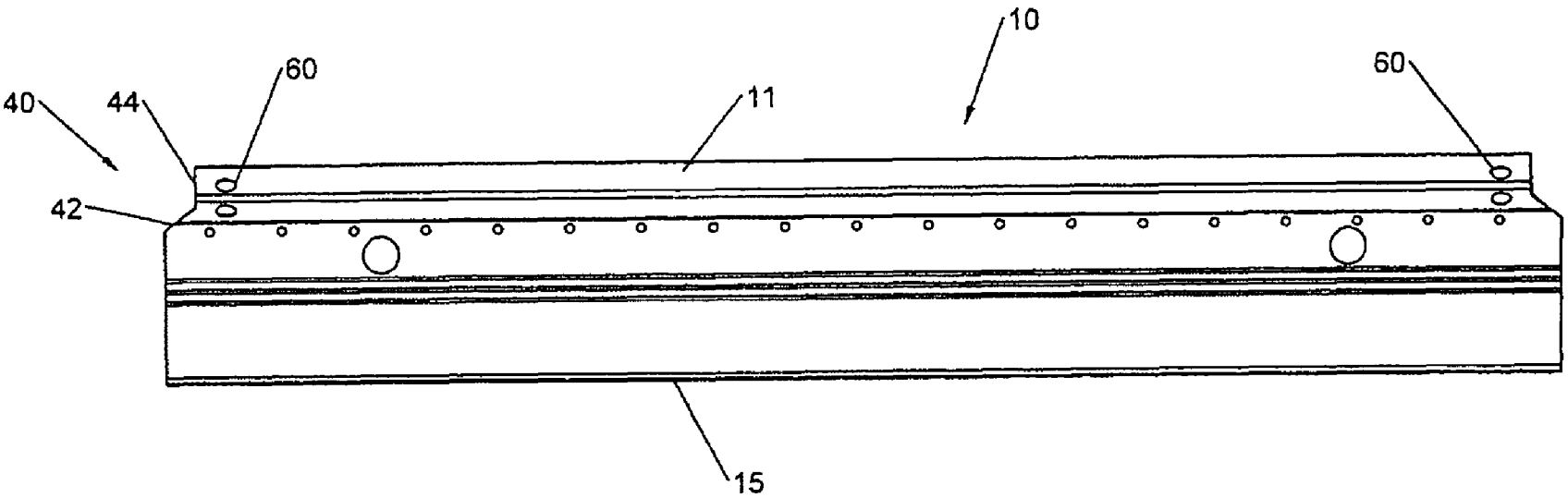
FIG. 6 is a side view of the toeboard showing end details thereof.

The toeboard clamp 20 includes a hinged band structure 21 which includes a wedge member 23 used for drawing the band structure into a tight grip engagement with the scaffold upright 6. The base hold down 24 engages the upper flange 11 of the toeboard 10 with the toeboard extending either side of the base member 24. The latch fingers 26 and 28 have engaged the perpendicular toeboard at a position forwardly of the initial toeboard 10 with latch finger 26 received within the finger retaining slot 60. Latch finger 28 is provided on the opposite side of the toeboard trapping the toeboard between the fingers. The end of the toeboard includes a notched portion 40 having an angled edge 42 and an upright portion 44 as shown in FIG. 4. The retaining slot 60 could take the form of the two holes shown in FIGS. 7 and 8.

The angled edge 42 slides under the flange 13 of a toeboard in engagement with the base hold down 24 such that the perpendicular toeboard 10 cannot move vertically. The base member 26 is pressed against the flange 11 to fix the first toeboard. The second toeboard 10 cannot move away from the upright post 6 along the axis of this second toeboard as the latch finger 26 is engaged in the finger receiving slot 60 and provides a positive lock.

The opposite spring finger 28 engages back face 53 of the toeboard. Spring finger 28 engages upper edge 63 of the toeboard as well as reinforcing rib 65 extending the length of the toeboard 10. The toeboard 10 is trapped between the latch fingers 26 and 28 and cannot move vertically as it is in engagement with the other toeboard and it cannot move along the axis of the other toeboard due to the latch fingers engaging the toeboard. This provides a simple arrangement for locking of two toeboards to an upright scaffold support 6 while allowing one toeboard to extend beyond the scaffold upright 6. The toeboards cannot move downwardly due to support on the work platform.

It can also be appreciated that the cross section of the toeboards 10 allows nesting of the toeboards as well as a sliding overlap of the toeboards to allow extension of the toeboards. The clamp 20 can be secured to any upright and can retain two toeboards in an overlapped relationship. The latched fingers 26 and 28 will engage and maintain the toeboards in their overlapped condition. The free ends of each latch fingers 26 and 28 are basically positioned to engage the wall 53 of the toeboard and maintain these walls in tight engagement. The base hold down 24 holds both toeboards in the overlapped partially nested condition.

The notching and angling of the toeboard 10 can be appreciated from FIG. 4. The angled edge 42 is designed to engage the lower flange 13 of an adjacent toeboard with the base hold down 24 engaging the upper flange 11 of the toeboard. As can be appreciated, the toeboard clamp 20 is effectively reversible and one of the latch fingers 26 and 28 will engage the appropriate latch slot 60 of the toeboard if the toeboards are in the perpendicular configuration of FIG. 2 and FIG. 3.

Figure 3:
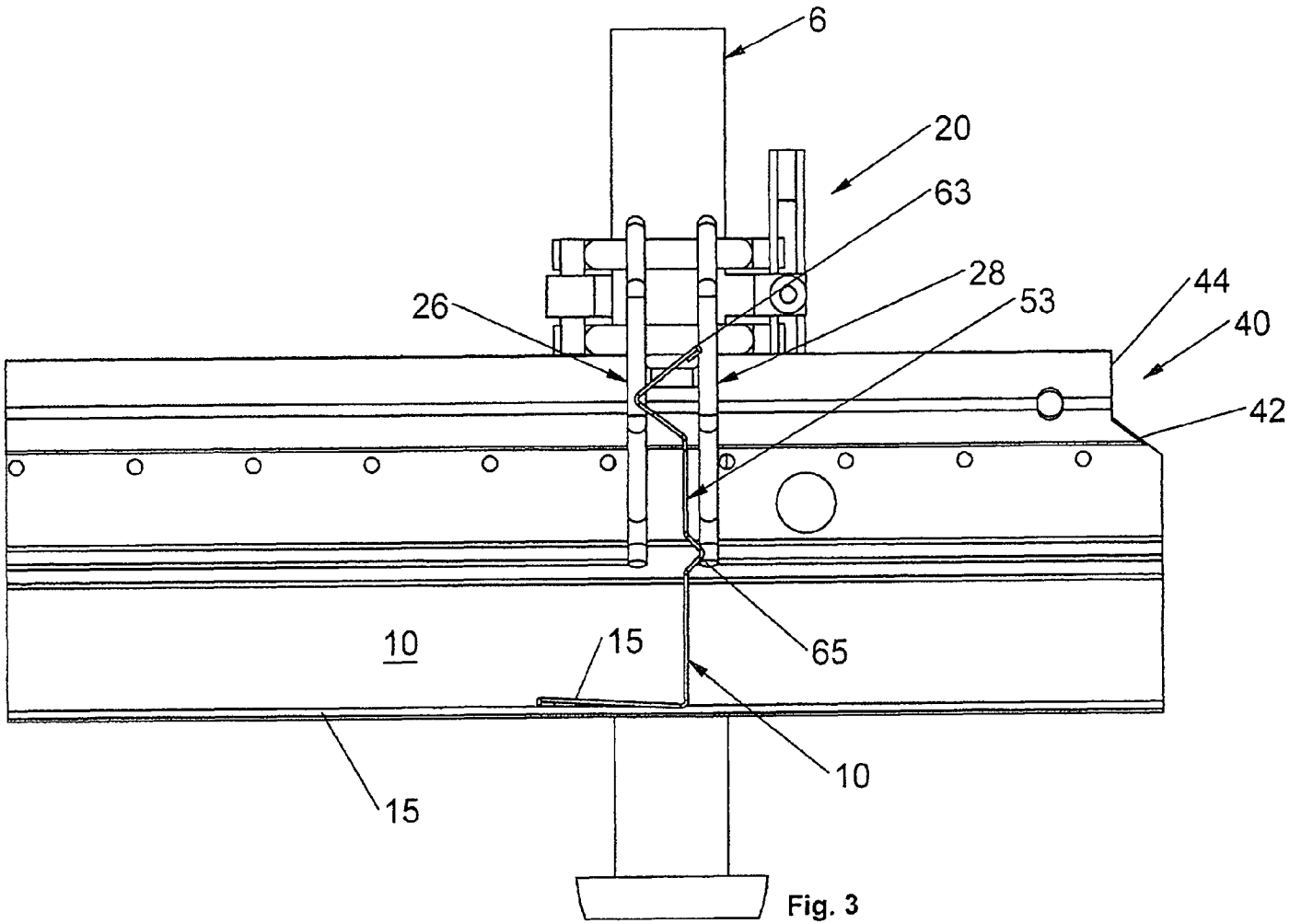
FIG. 3 is an end view of a perpendicular toeboard secured by a toeboard clamp to a longitudinal toeboard.

The end view of the perpendicular toeboard 10 of FIG. 3 shows the shape of the toeboard and the overlapped condition of two toeboards to extend the length of a toeboard surface or to define a perpendicular corner configuration.

Figure 7:
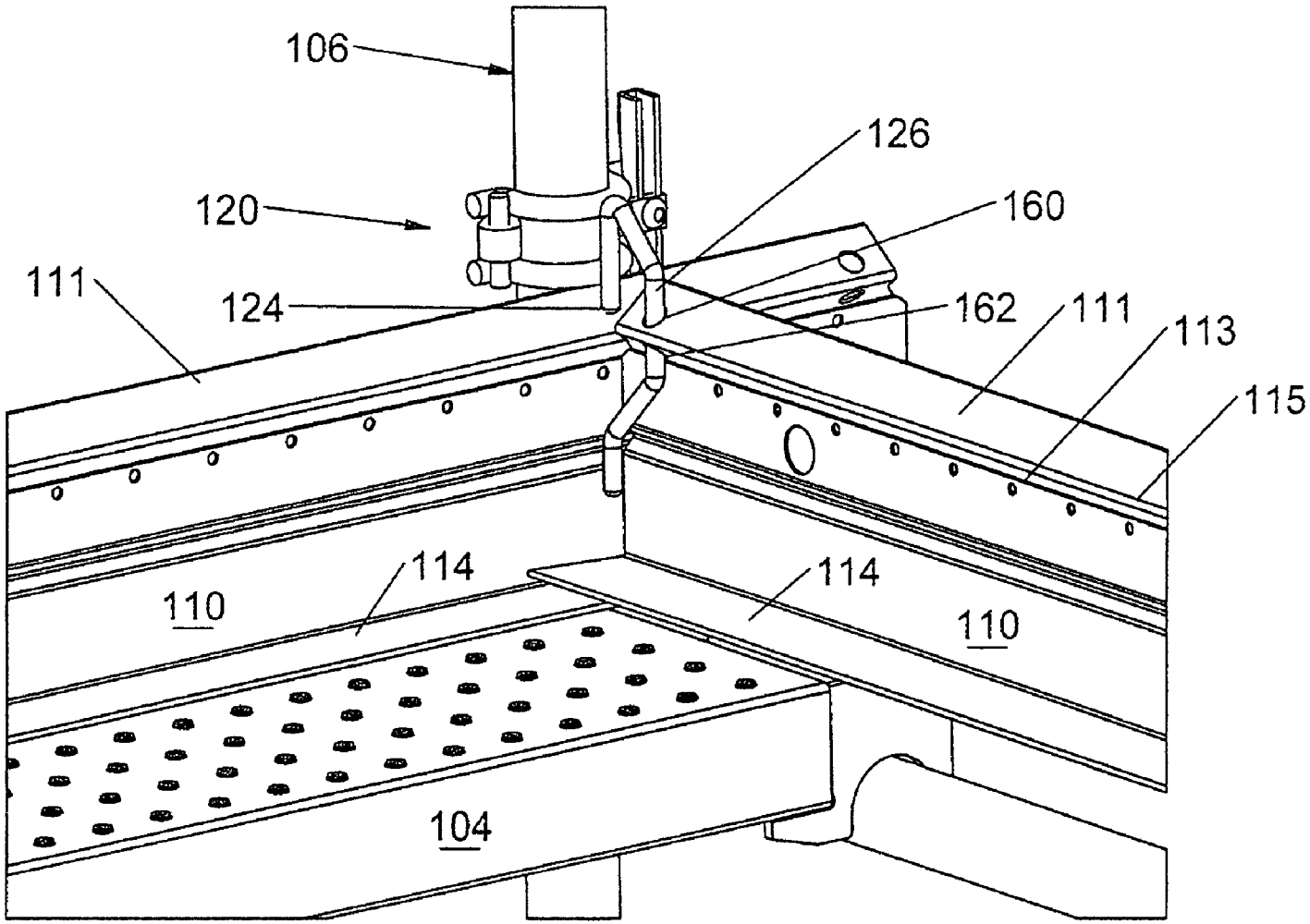
FIG. 7 is a corner perspective of a modified toeboard clamp arrangement.
Figure 8:
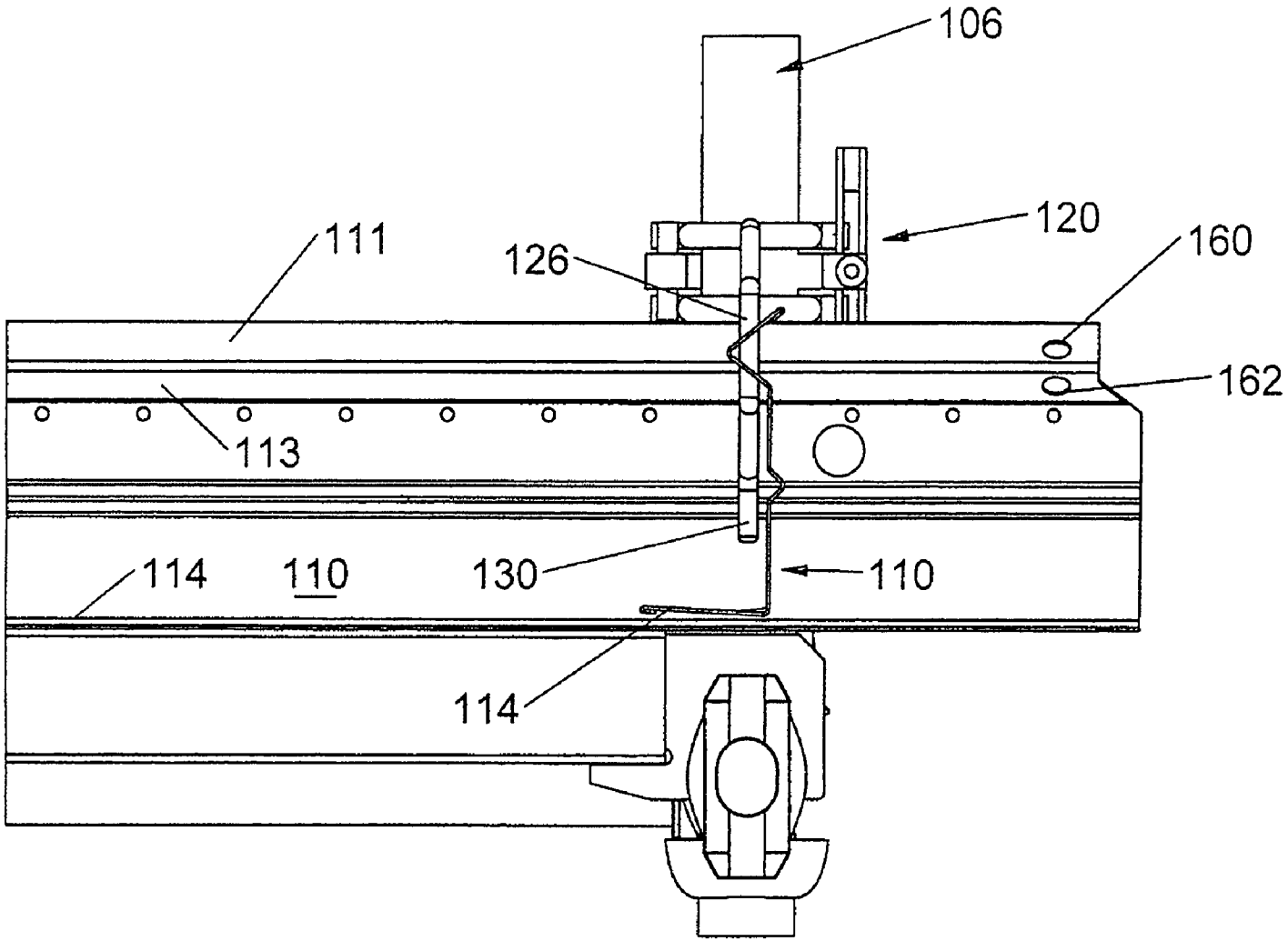
FIGS. 8 and 9 are opposite end views of the modified toeboard clamp arrangement of FIG. 7.
Figure 9:
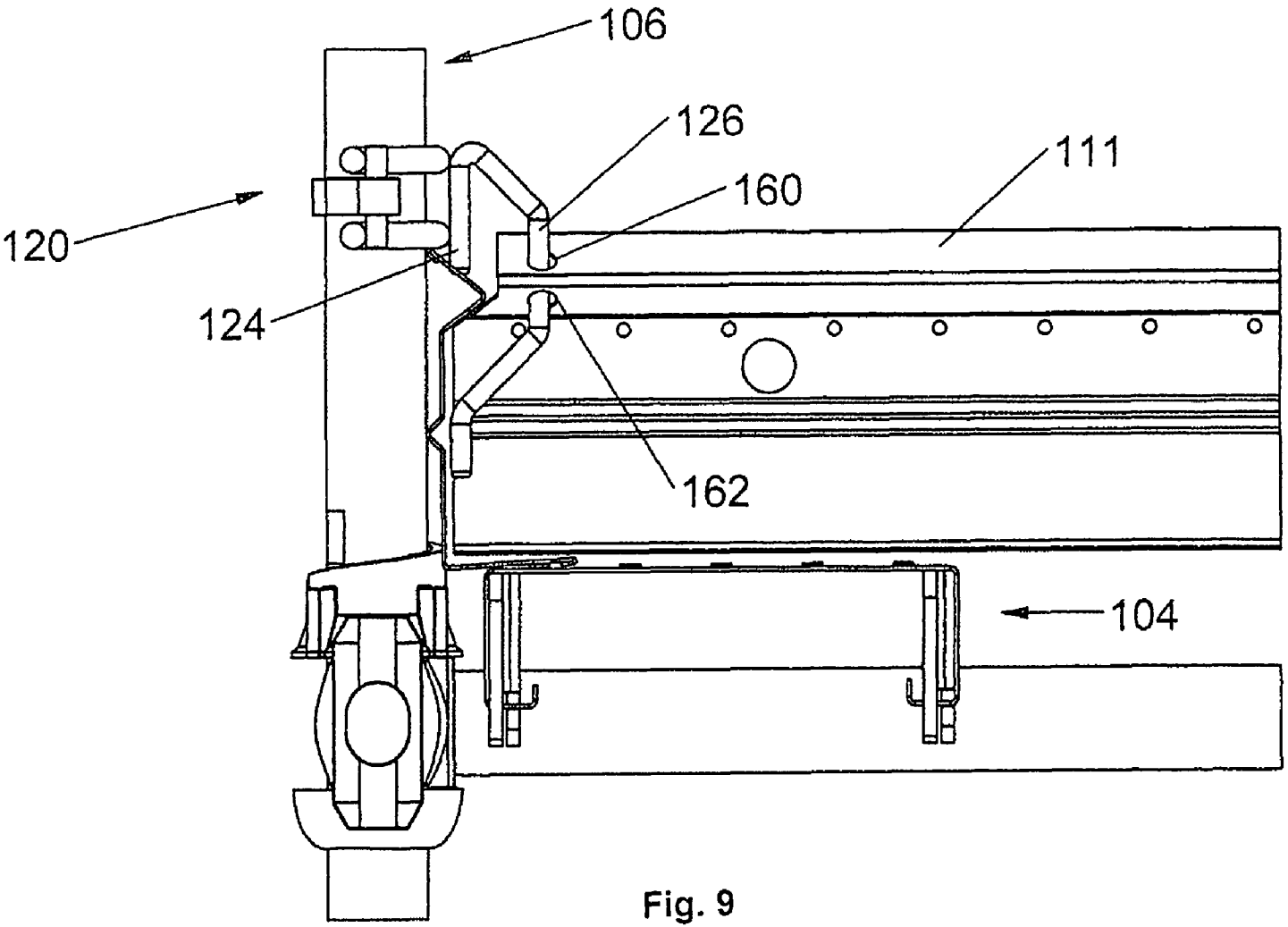

An alternate toeboard arrangement 100 is shown in FIGS. 7, 8 and 9. In this alternate structure, the toeboards 110 are shown supported by the work planks 104 appropriately attached to the scaffold upright 106.

The toeboard clamp 120 in this case includes a single latch finger 120 which cooperates with the base hold down member 124 which is attached to the band of the toeboard clamp. As shown in FIG. 7, the base hold down 124 contacts the upper flange 111 of the toeboard and prevents upward movement of the toeboard. The perpendicular toeboard 110 in this case includes finger retaining ports 160 and 162 which pass through the inwardly directed upper portion of the toeboard defined by the upper flange 111. Flange 111 is a downwardly angled flange in combination with the inwardly and downwardly angled flange 113 joined by the corner 115.

The finger retaining port 160 and 162 are aligned to allow the single latch finger 126 to pass therethrough. The latch finger 126 draws the perpendicular toeboard into engagement with the other toeboard which is held in place by the base hold down 124. Each of the toeboards is supported on the work platform 104 by a support flange 114.

As shown in FIG. 8, the latch finger 126 effectively maintains the position of the perpendicular toeboard 110 and draws this toeboard against the longitudinal toeboard and against the support upright 106.

The latch finger 126 includes the general shape of the latch fingers 26 and 28 of the earlier structure and thus the free end 130 of the latch finger 126 serves to retain the longitudinally extending toeboard 110 against the upright 106. The toeboards 110 of FIGS. 7, 8 and 9 also include the notched end configuration as described in the earlier Figures. In this way the perpendicular toeboard is effectively held underneath the flange 113 of the other toeboard and cannot move vertically. Similarly, the base member 124 assures that the other toeboard cannot move vertically. With this arrangement, as shown in FIGS. 7, 8 and 9, the toeboard can extend beyond the upright 106 and need not be of a specific modular length as required in many prior art systems.

It can also be appreciated from the various view of FIGS. 7, 8 and 9 that a toeboard can effectively nest with a like toeboard and provide a slide overlap. This allows adjustment in the length of the combined toeboards and also assists in storage of the toeboards when they are not in use. The slide overlap can also allow the overlapped toeboards to adjust in length to end at the uprights.

As can be appreciated from FIGS. 7, 8 and 9, the finger retaining ports 160 and 162 are provided at the end of the toeboard and are used for providing an interlocking perpendicular connection between toeboards.

The present invention and in particular the toeboard clamp preferably includes two latch fingers spaced one from the other for engaging opposite sides of the toeboard with one of these spring fingers also engaging the toeboard in a manner to restrict movement of the toeboard relative to the finger along the longitudinal direction of the toeboard. The spacing between the fingers is such to snugly engage the toeboard on opposite sides thereof. It is possible to use a single finger passing through a hole (or a pair of holes) typically in the top of the toeboard so that the finger engages the toeboard and also provides positive restriction of movement along the longitudinal axis of the toeboard.

Whether a single latch finger or two latch fingers are used, these fingers are typically of a bent shape and the clamp is initially loosely provided adjacent the upright support 6 with the finger or fingers fed through or into engagement with a slot, port or walls of a toeboard to effect securement. The band portion of the clamp can then be tightly drawn around the upright support to positively maintain the toeboards in their desired position. When two toeboards are placed in overlapped condition, it is easier to place the fingers to the outside of the overlapped toeboards and draw the toeboards into an engagement with the upright support post 6.

Although various preferred embodiments of the present invention have been described herein in detail, it will be appreciated by those skilled in the art, that variations may be made thereto without departing from the spirit of the invention or the scope of the appended claims.

The invention claimed is:

1. A toeboard system comprising:

a series of toeboards and a series of toeboard clamps for securing said toeboards relative to a support upright;

each toeboard being a metal component of a common cross section comprising a base flange and an upright portion to one side of and extending along the length of said base flange; said upright portion at an upper edge thereof including a V flange extending inwardly from said upright portion over said base flange and then outwardly and upwardly;

each toeboard clamp comprising a hinged band structure shaped to engage and provide a clamping force about a scaffold upright, a toeboard engaging structure to one side of said band structure including a base for engaging an upper surface of the V flange of one of said toeboards when received between said band structure and said toeboard engaging structure; said toeboard engaging structure including a toeboard finger latch extending beyond said base for engagement with an end of a further one of said toeboards to form a generally perpendicular corner between toeboards at said clamp.

2. A toeboard system as claimed in claim 1 wherein said toeboard finger latch is a pair of finger arms centered on said base and extending above and below said base.

3. A toeboard system as claimed in claim 2 wherein said finger arms are parallel to each other.

4. A toeboard system as claimed in claim 3 wherein said finger arms are attached to said hinged band structure with said base attached to and joining said finger arms.

5. A toeboard system as claimed in claim 3 wherein said finger arms angle downwardly and outwardly from said band and at a position forward of said band extend downwardly to a position generally below said base and then extend downwardly and inwardly terminating at a position generally aligned and below said base.

6. A toeboard system as claimed in claim 1 wherein each toeboard is of a cross section to nest one with the other.

7. A toeboard system as claimed in claim 6 wherein each toeboard includes a notched end portion adapted to engage and overlap with the V flange of one of said toeboards forming a corner connection therewith.

8. A toeboard system as claimed in claim 7 wherein said V flange of each toeboard includes a finger latch slot adjacent each notched end portion.

9. A toeboard system as claimed in claim 7 wherein said V flange of each toeboard includes two aligned ports for engaging a clamp finger latch of said clamps.

* * * * *